United States Patent [19]

Vassallo et al.

[11] Patent Number: 4,640,946

[45] Date of Patent: Feb. 3, 1987

[54] POLYVINYL ALCOHOL BASED WAX-FREE SIZE COMPOSITION

[75] Inventors: Donald A. Vassallo; David W. Zunker, both of Wilmington, Del.

[73] Assignee: E. I. Du Pont de Nemours and Company, Wilmington, Del.

[21] Appl. No.: 765,619

[22] Filed: Aug. 14, 1985

Related U.S. Application Data

[63] Continuation-in-part of Ser. No. 642,435, Aug. 20, 1984, abandoned.

[51] Int. Cl.[4] ..... C08J 3/04; C08L 3/00; C07C 43/11

[52] U.S. Cl. ..... 524/45; 524/47; 524/366; 524/378; 524/379; 524/385; 568/618; 568/622; 568/678; 8/115.6

[58] Field of Search ..... 524/45, 47, 366, 378, 524/379, 385; 568/618, 622, 678; 8/532, 115.6

[56] References Cited

U.S. PATENT DOCUMENTS

| | | | |
|---|---|---|---|
| 2,694,021 | 11/1954 | Griffin | 252/8.9 |
| 4,330,337 | 6/1982 | Graham | 106/213 |
| 4,460,374 | 7/1984 | Abel et al. | 8/648 |

OTHER PUBLICATIONS

Schönfeldt, "Surface Active Ethylene Oxide Adducts", 1969, Pergamon Press, Oxford, pp. 499, 503 and 504.

*Primary Examiner*—John Kight
*Assistant Examiner*—Nathan M. Nutter

[57] ABSTRACT

Polyvinyl alcohol based sizing solution containing a small amount of low ethylene oxide adduct of branched alcohol provides superior operability during sizing and weaving, and yields fabric that exhibits improved finishing performance.

20 Claims, No Drawings

POLYVINYL ALCOHOL BASED WAX-FREE SIZE COMPOSITION

CROSS-REFERENCE TO RELATED APPLICATION

This application is a continuation-in-part of copending application Ser. No. 642,435 filed Aug. 20, 1984 and now abandoned.

BACKGROUND OF THE INVENTION

1. Field of the Invention

This invention relates to size compositions and more specifically it relates to polyvinyl alcohol based size compositions containing low ethylene oxide adduct additives.

2. Description of the Prior Art

Spun warp yarn must be sized with a water-soluble polymer which provides it with a protective surface coating the latter is required during the weaving of the yarn into fabric. After weaving the greige fabric produced must be stripped of the protective coating by desizing before it can be subjected to various finishing operations and in oarticular to dyeing. Sizes based on polyvinyl alcohol or combinations of polyvinyl alcohol and starch must generally be used with a wax additive present in the formulation to minimize drier drum sticking in the slasher during application of the size. These wax additives are difficult to remove from the greige fabric during desizing, often requiring extraction by special solvents as well as higher desize bath temperatures. As a consequence the finishing mill is faced with higher production costs due to greater process complexibility, higher energy costs and a higher percentage of second quality greige fabric.

The use of polyvinyl alcohol-based sizing solution containing a small amount of quaternary ammonium salt or a quaternary imidazolinium salt is disclosed in U.S. Pat. No. 4,383,063; these additives provide good operability in the absence of wax and result in fabric exhibiting improved finishing performance. However, such formulations have the serious deficiency of frequently exhibiting a non-reproducible sizing performance; the latter is due to an erratic and unpredictable removal of the cationic additive by inter-action with anionic contaminants which tend to accumulate in the sizing solution. The primary source of these anionic contaminants is the spun varn being sized.

The incorporation into polyvinyl alcohol-based sizes of very low levels (maximum of 0.05 wt. % based on polvvinyl alcohol) of low ethoxylate adducts of linear alcohols as defoaming agents is disclosed in U.S. Pat. No. 4,251,403; such materials have been found to be ineffective as wax substitutes and therefore are not used as substitutes for wax in wax-free warp sizing compositions.

SUMMARY OF THE INVENTION

According to the present invention, there is provided a composition consisting essentially of (a) from about 45.5 to about 99.9% by weight of vinyl alcohol polymer selected from the group consisting of polyvinvl alcohol, vinyl alcohol/methyl methacrylate copolymer, and polyvinyl alcohol containing solubilizing comonomers other than methyl methacrylate, said vinvl alcohol polymer having a saponification number of from about 1 to about 160 and a 4 percent solution viscosity of from about 3 to about 70 mPa.s at 20° C.;

(b) from about 0.1 to about 3 percent by weight of liquid nonionic low ethylene oxide adduct of branched alcohol or mixture of branched alcohols wherein the average ethylene oxide content is from about 1 to about 7 units and the alcohol has an average carbon content of from about 8 to about 18 carbon atoms;

(c) from 0 to 49.9 percent by weight of starch;

(d) from 0 to about 5 percent by weight of ethylene oxide oligomer having a molecular weight (number average) of from about 200 to about 800 and (e) from 0 to about 49.9 percent by weight of carboxymethyl cellulose, (f) from 0 to about 1 percent by weight of at least one auxiliary ethylene oxide adduct selected from the group consisting of low ethylene oxide adduct (containing an average ethylene oxide content of from about 1 to about 7 units) of a linear alcohol or of a mixture of linear alcohols (having an average carbon content of from about 8 to about 18 units) and medium to high ethylene oxide adduct (containing an average ethylene oxide content of from about 8 to about 40 units) of linear or branched alcohols (having an average carbon content of from about 8 to about 18 units) provided the combined weight of starch and carboxymethyl cellulose does not exceed the weight of vinyl alcohol polymer.

Further according to the present invention there is provided a concentrate of the low ethylene oxide adduct blended with vinyl alcohol polymer, a wax-free aqueous size solution comprising the composition of the present invention having a solids content of 2–20% by weight, process for sizing filament yarn with wax-free aqueous solution and sized yarn comprising spun yarn having a wax-free protective surface coating of the composition of the present invention.

As used herein, the term "consisting essentially of" means that the named ingredients are essential, however, other ingredients which do not prevent the advantages of the present invention from being realized can also be included.

DETAILED DESCRIPTION OF THE INVENTION

It has been found that the addition of a liquid, nonionic, low ethylene oxide adduct of a branched alcohol, in the amount of 3 percent or less, to the vinyl alcohol polymer based size composition eliminates sticking of the sized yarn on the drying cans in the slasher, provides excellent weaving efficiency, and easy size removal under mild desize conditions, yielding desized greige fabric that exhibits excellent dye receptivity. Size comoositions of the present invention are recommended for use in the conventional sizing, heat setting and aqueous desizing operations presently employed by spun yarn textile mills.

For the purposes of the size compositions of the present invention the vinyl alcohol polymer can have a saponification number (mg KOH to neutralize 1 g polymer) of from about 1 to about 160 and a 4 percent solution viscosity of from about 3 to about 70 mPa.s.

Examples of suitable vinyl alcohol polymers include:

(a) Fully hydrolyzed vinyl alcohol/methyl methacrylate copolymer (containing from about 3.5 to about 6 mole percent methyl methacrylate) having a viscosity of from about 3 to about 60 mPa.s (measured at 20° C. using a 4 percent aqueous solution). Such copolymers can be produced by the alcoholysis of a vinyl acetate/-methyl methacrylate copolymer;

(b) Partially hydrolyzed polyvinyl alcohol containing from about 4 to about 12 mole percent of vinyl acetate having a viscosity of from about 3 to about 60 mPa.s;

(c) Fully hvdrolyzed polyvinyl alcohol having a viscosity of from about 3 to about 70 mPa.s (d) Polyvinyl alcohol containing "solubilizing comonomers" other than methyl methacrylate (such as methylacrylate, methyl hydrogen maleate;

(e) Various mixtures of the above vinyl alcohol polymers.

The nonionic additive of the present invention is a low ethylene oxide adduct (containing an average ethylene oxide content of from about 1 to about 7 units) of a branched alcohol or a mixture of branched alcohols (having an average carbon content of from about 8 to about 18 units). The preferred makeup of this additive is an adduct containing from about 2 to about 5 ethylene oxide units with a branched alcohol containing an average of from about 10 to about 15 carbon atoms. The most preferred is one consisting of an average of about 3 ethylene oxide units with a branched alcohol containing an average of about 13 carbon atoms. "Tergitol" 15-S-3, a product manufactured by Union Carbide, represents this most preferred additive. "Branched alcohol" means an alcohol which has branching in the carbon chain at the position alpha to its linkage to the ethylene oxide chain. Thus secondary or tertiary alcohol adducts are encompassed by our definition of "branched," while primary alcohol adducts are excluded, as are compounds which contain secondary alcohol groups which are not involved in the linkage to the polyethylene oxide.

The amount of vinyl alcohol polymer in the composition of the present invention is from about 45.5 to about 99.9 percent by weight. The preferred range is from about 63 to about 99.8 percent and the most preferred range is from about 72.7 to about 99.6 percent. In typical polyvinyl alcohol-based size formulations, the higher the polyvinyl alcohol content of the size, the higher will be the weaving efficiency exhibited by the sized yarn. In general size add-on requirements are reduced progressively as the polvvinyl alcohol content of the size is increased.

The amount of the nonionic additive of the present invention is from about 0.1 to about 3 percent by weight. About 0.1 weight percent additive is necessary to give significant drier drum release, while greater than about 3 weight percent may result in reduced weaving efficiencies. A preferred range of additive is from about 0.2 to about 1.5 weight percent with which most of the benefits of the present invention can be achieved. The most preferred concentration range of additive is from about 0.4 to about 0.8 weight percent; compositions containing this level of additive give the best balance of drum deposit performance, abrasion resistance and dye receptivity after desizing.

Optionally, starch can be incorporated in the size compositions of the present invention in an amount of up to about 49.9 weight percent. Up to this level of starch the benefits of the no-wax additive of the present invention are clearly evident. The preferred starch limit is up to about 33 weight percent, while the most preferred starch limit is up to about 25 weight percent. In the most preferred vinyl alcohol polymer/starch blends the effectiveness of the nonionic additive of the present invention approaches that observed with compositions containing vinyl alcohol polymer as the sole polymeric component. A variety of types of starch and derived starch will function as optional additives in the composition of this invention. These include "Kofilm" 50, [an acetylated starch product supplied by National Starch], as well as "Astrogum" 3010 [a medium viscosity sodium carboxymethylated starch] and "Astrogum" 3020 [a low viscosity sodium carboxymethylated starch], which are products supplied by Penick and Ford.

Carboxymethyl cellulose (CMC) can also be used as an optional ingredient in the composition of the present invention in an amount of up to about 50 wt. %, preferably up to about 33 wt. %, and most preferably up to about 25 wt. %.

The combined weight of the starch and CMC ingredients should not exceed the weight of the vinyl alcohol polymer present in the composition.

Another optional additive is a low to medium molecular weight (200–800 number average) oligomer of ethylene oxide often added to vinyl alcohol polymer as a dedusting agent. U.S. Pat. No. 4,389,506 describes the use of 3 weight percent of "Carbowax" 600, a product of Union Carbide, as yielding the most preferred dust-free product. Concentrations up to about 5 weight percent "Carbowax" 600 result in only minor reductions in the benefits derived from the presence of the nonionic additive of the present invention and represents the upper additive level recommended. A preferred upper limit is 3 weight oercent while the most preferred upper limit of this tvpe of additive is 1.5 weight percent. At the most preferred upper concentration the benefits derived from the nonionic additive of the present invention can be almost fully realized.

Further optional additives can be auxiliary low ethylene oxide adducts (containing an average ethylene oxide content of from about 1 to about 7 units) of a linear alcohol or of a mixture of linear alcohols (having an average carbon content of from about 8 to about 18 units) or medium to high ethylene oxide adducts (containing an average ethylene oxide content of from about 8 to about 40 units) of linear or branched alcohols (having an average carbon content of from about 8 to about 18 units). These additives can be present in the composition of the present invention in low concentrations, i.e. up to about 1 wt. percent.

The aqueous size solution of the present invention will generally have a solids content of from about 2 to about 20 weight percent. The preferred size bath solids content is from about 5 to about 15 weight percent while the most preferred formulation contains from about 7 to about 12 weight percent since this level of solids in most cases will provide sufficient size add-on to give the sized yarn adequate abrasion resistance. The aqueous polyvinyl alcohol based size solution is considered to be unique because it does not contain a wax additive which must be present under normal mill conditions.

The aqueous size solution is prepared by slurrying polyvinyl alcohol with water at ambient temperature. The nonionic additive along with any optional additives are then introduced. The subsequent mixture is heated with stirring at about 77° C. until complete solution has been achieved.

The size solution of the present invention can also be prepared directly from a blend of vinyl alcohol polymer with a low amount of the nonionic additive of the present invention. The polyvinyl alcohol/nonionic additive mixtures of this invention are produced by dry blending a variety of polyvinyl alcohol and the additive(s) under high intensity mixing conditions at a temperature at which the additive component(s) will be liquid(s). Moreover if more than one nonionic additive is used, the latter can be preblended and added as a single component. For example, using a Readco Sigma Blade mixer manufactured by the Read Co., York, PA, polyvinyl alcohol and "Tergitol" 15-S-3 or "Tergitol" 15-S-3/"Carbowax" 600 mixtures were converted into homogeneous blends by mixing for about 30 minutes at a temperature above about 20° C. This mode of preparation is carried out by slurrying in water at ambient temperature the required amount of vinyl alcohol polymer/nonionic additive blend to give the desired size bath solids. The resulting mixture is then heated with stirring at a temperature of about 77° C. until complete solution has been achieved.

The size solution of the present invention can also be produced by using a concentrate of the nonionic additive of the present invention in a vinyl alcohol polymer. The concentrate consists essentially of from about 45 to about 90 percent by weight of vinyl alcohol polymer and from about 10 to about 55 percent by weight of the liquid, nonionic low ethylene oxide adduct additive of the present invention. Optionally, the concentrate can contain up to about 45 percent by weight of starch, up to about 45 percent by weight of Carbowax, up to about 45 percent by weight of carboxymethyl cellulose and up to about 45 percent by weight of low ethylene oxide adduct of a linear alcohol or mixture of linear alcohols or medium to high ethylene oxide adduct of linear or branched alcohols. The concentrate is used to produce the size composition of the present invention by adding it in the required amount to a preformed vinyl alcohol polymer solution. Use of such a concentrate can provide a unique and surprising advantage. Normally when vinyl alcohol polymers are added even with vigorous agitation to hot aqueous solutions, the vinyl alcohol component fuses upon contact with the hot water and becomes very difficultly soluble. In contrast the above described concentrate, if it contains at least about 30% by weight of the nonionic additive of this invention, is relatively easy to disperse when added directly to hot water. The most preferred nonionic additive level is from about 40% to about 50%. Above about 50% the vinyl alcohol polymer tends not to absorb all of the additive. Use of the above described concentrate provides the highly desirable advantage of permitting rapid readjustments in the level of the nonionic additive of the present invention in a given hot size bath to match specific mill requirement.

Preferably, the above referred to concentrate contains from about 45 to about 70 percent by weight of vinyl alcohol polymer, from about 30 to about 55 percent by weight of nonionic additive, up to about 20 percent by weight of starch, up to about 20 percent by weight of Carbowax, and up to about 20 percent by weight of carboxymethyl cellulose. Most preferably the concentrate will contain from about 50 to about 60 percent by weight of vinyl alcohol polymer, from about 40 to about 50 percent by weight of nonionic additive, up to about 5 percent by weight of starch, up to about 5 percent by weight of Carbowax and up to about 5 percent by weight of carboxymethyl cellulose.

The size is applied to the yarn web or sley using a slasher. The latter is equipped with a heated size box containing the size formulation. The unsized sley is sized by being drawn through the hot size solution, through squeeze rolls to remove excess size solution, over a series of heated drying drums, through a bust bar assembly to separate the sley into individual warp ends and finally onto a beam for collection. When the required amount of sized sley has been collected on the beam, the latter is installed in a loom where the yarn is woven into greige fabric.

The sized spun yarn produced using the size composition of the present invention has a wax-free protective surface coating and exhibits the unique property of providing excellent weaving performance despite the absence of wax in the vinyl alcohol polymer based size. Moreover the greige fabric produced being wax-free, is readily desizable under mild desize conditions yielding a desized fabric with excellent dye receptivity. Desizing is carried out by passing the sized greige fabric through an alkaline scour bath followed by several hot water (about 65°-85° C.) rinses. Fabric prepared with conventional wax-containing sizes requires much more stringent scouring and rinse conditions than are required with the size formulations of the present invention. A high level of removal of the size components from the greige fabric is required prior to its processing in the finishing mill so as to permit efficient and reproducible dyeing as well as other finishing operations on the fabric. Both the no-wax sized yarn and the no-wax greige fabric produced from it are thus considered to be unique.

The no-wax size composition of the present invention is especially suited for use with polyester/cotton spun yarn blends. It is particularly useful for 65/35, 50/50 and 40/60 polyester/cotton spun yarn blends. The size composition also has utility for 100% cotton spun yarns.

Incorporation of the no-wax additive of the present invention into vinyl alcohol polymer based size formulations permits the elimination of wax as an additive, making feasible the preparation of sized yarn exhibiting excellent slashing and weaving characteristics suitable for producing a variety of types of fabrics under typical weaving conditions (e.g. involving shuttle, airjet, rapier looms). The derived fabrics, being wax-free, are characterized by easy size removal and the desized fabric exhibits superior dye receptivity.

The following examples are given for the purpose of illustrating the present invention. All parts and percentages are by weight unless otherwise specified.

EXAMPLES

Sizing solutions were prepared in a steam-jacketed kettle by adding the vinyl alcohol polymer to the requisite amount of ambient temperature water to obtain the desired size bath solids. The temperature of the slurry was brought to 77° C. with stirring. Any additives to be tested in the formulation were added at this point.

The resulting size solution was used to size 24 ends of a polyester/cotton spun yarn using a "Callaway Slasher" Model 51 manufactured by West Point Foundry and Machine Co. operated at 10 meters/minute using pressure at the squeeze roll. After the yarn had been sized, the size add-on was measured by weight loss after extraction of the sized yarn with boiling water. Assessment of the performance of the size formulation during slashing as well as characterization of the sized yarn itself was carried out using the following test procedures.

(a) Drum deposits

The extent to which deposits form on the No. 1 drying drum in the slasher is related directly to the tendency of a given size formulation to cause sticking of the individual warp ends to the drying drums in the slasher. Thus the effectiveness of a release agent added to the size formulation to minimize yarn sticking in the drying section of the slasher can be measured accurately. Operating the Callaway slasher under the conditions described above and setting the temperature of the No. 1 drying drum at 190° C. and the remaining three drums at 220° C., the amount of deposit accumulating on the No. 1 drum will reach an equilibrium value in about one minute. Once equilibrium is achieved the deposits on this drum are removed quantitatively with a rubber squeegee during one complete revolution of the drum; the deposit is then dried and weighed. The amount of deposit collected provides a direct measure of a size formulation's performance, namely the greater the amount of drum deposit, the greater the tendency the formulation has to cause drying drum sticking. Of the various all vinyl alcohol polymer based size formulations evaluated during the course of this study, the highest drum deposit was observed with unmodified PVA No. 2 (a fully hydrolyzed vinyl alcohol/methyl acrylate copolymer having a 4% solution viscosity of 13.5 mPa.s and a saponification number of 40). In each example cited, the actual drum deposit value observed and a rating proportionated against the PVA No. 2 value (unless noted otherwise) are given. A rating of 0.200 or lower is considered necessary for operability under typical mill conditions of a 100% vinyl alcohol polymer size.

(b) Abrasion resistance of the sized yarn is determined using a laboratory abrasion tester. The test method employed consists of stringing 21 ends of sized yarn through a section of conventional weaving loom reed and applying controlled tension to each individual warp end. The reed is made to oscillate against the warp ends at one cycle/second and the number of cycles required to cause the breakage of each end is recorded. A second set of 21 ends is next tested in the same manner. The two sets of data obtained are then statistically averaged so as to give the number of cycles required to cause 50% breakage of the warp ends used in the test. This quantity in cycles is referred to as the $F_{50}$ rating for a given size formulation.

Abrasion resistance is highly dependent upon size add-on. For comparative purposes all $F_{50}$ data must be normalized to a given size add-on, namely, 10%. This is preferably done by obtaining $F_{50}$ values at six or more add-ons for a given size formulation and subjecting the resulting data to a linear regression analysis. All $F_{50}$ data reported in the characterization of the various examples cited have been treated in this manner. A maximum $F_{50}$ value was observed for size formulations prepared with PVA No. 1 (a fully hydrolyzed vinyl alcohol/methyl methacrylate copolymer having a 4% solution viscosity of 28 mPa.s and having a saponification number of 30). In all examples cited the actual $F_{50}$ value observed and a comparison rating with the PVA No. 1 size (unless otherwise noted) are given; the latter was calculated by setting at unity the log $F_{50}$ value of the PVA No. 1 size at 10% size add-on and proportionating against it the log $F_{50}$ value observed at 10% size add-on for the size formulation in the example. At 10% add-on a rating of 0.875 or higher is considered to be a requirement for operability under typical mill conditions using a 100% vinyl alcohol polymer size.

(c) Dye receptivity

Sized yarn to be used in this test is first heat set by passing it through an oven at 200° C. with a holdup time of 45 seconds. The heat-treated yarn is then desized under mild conditions consisting of soaking the yarn for 15 seconds at 55° C. in a 0.5% Alkanol WXN (a modified sodium alkylaryl sulfonate supplied by E. I. du Pont de Nemours and Company) solution followed by rinsing the yarn for 45 seconds at 75° C. three times. After passage through a wringer the yarn is dried thoroughly. Using the dried, desized yarn its dye receptivity is determined by measuring the time in seconds for an aqueous solution of Chemurgy green dye to penetrate one inch up a hank of dry yarn. The poorest dye receptivity was observed using PVA No. 1 containing 8% "Synchem" 110 wax (a solid hot water dispersible tallow wax, supplied by Milliken). Setting this value at unity all other dye receptivity values for the examples cited have been proportionated against it. Thus in each example given both the observed dye receptivity as well as a dye receptivity rating are reported. A rating of 3.5 or higher is considered to be necessary to achieve good dye receptivity under normal mill conditions.

EXAMPLE 1 AND COMPARATIVE EXAMPLES 1 AND 2

A sizing solution based on PVA No. 2 containing 0.4% "Tergitol" 15-S-3 (Ex. 1) was tested at 12 size add-on levels ranging from 5–15% (based on yarn weight) and compared with similar formulations prepared with PVA No. 2 alone (Ex. C-1) and PVA No. 2 containing 8% "Synchem" 110 wax (typical mill formulation) (Ex. C-2). Results are summarized in Table I.

TABLE I

| | | Drum Deposit | | $F_{50}$ Abrasion Resistance | | Dye Receptivity | |
|---|---|---|---|---|---|---|---|
| Example | Composition | Obs'd (mg) | Rating | Obs'd (Cycles) | Rating | Obs'd (Sec) | Rating |
| 1 | PVA No. 2 + 0.4% "Tergitol" 15-S-3 | 1.1 | 0.066 | 1640 | 0.939 | 3.5 | 6.257 |
| C-1 | PVA No. 2 | 16.8 | 1.000 | 1845 | 0.954 | 4.5 | 4.867 |
| C-2 | PVA No. 2 + 8% "Synchem" 110 wax | 0.2 | 0.006 | 1185 | 0.900 | 20.7 | 1.058 |

As can be seen from the above data, Example 1, which represents an embodiment of the present invention, provided yarn having acceptable combinations of the three key performance features, comparative Examples 1 and 2 were unacceptable because in C-1 the drum deposit was too high, and in C-2 the dye receptivity was extremely poor.

EXAMPLE 2 AND COMPARATIVE EXAMPLES 3 AND 4

A sizing solution based on PVA No. 1 containing 0.4% "Tergitol" 15-S-3 (Ex. 2) was evaluated at 12 size add-on levels falling in the range of 5–15% (based on yarn weight) and compared with similar formulations based on PVA No. 1 alone (Ex. C-3) and PVA No. 1+8% "Synchem" 110 wax (typical mill formulation (Ex. C-4) and PVA No. 1 containing 0.4% "Tergitol" 15-S-3 and 1.5% "Carbowax" (Ex. 4). Results are summarized in Table II.

TABLE II

| Example | Composition | Drum Deposit Obs'd (mg) | Drum Deposit Rating | $F_{50}$ Abrasion Resistance Obs'd (Cycles) | $F_{50}$ Abrasion Resistance Rating | Dye Receptivity Obs'd (Sec) | Dye Receptivity Rating |
|---|---|---|---|---|---|---|---|
| 2 | PVA No. 1 + 0.4% "Tergitol" 15-S-3 | 0.5 | 0.030 | 1815 | 0.952 | 4.3 | 5.102 |
| C-3 | PVA No. 1 | 6.6 | 0.393 | 2655 | 1.000 | 4.2 | 5.208 |
| C-4 | PVA No. 1 + 8% "Synchem" 110 Wax | 0.1 | 0.006 | 1060 | 0.884 | 21.9 | 1.000 |

The above data illustrate that the same advantages reported in Example 1 could be realized using the additive of the present invention with an alternative grade of vinyl alcohol polymer.

EXAMPLE 3 AND COMPARATIVE EXAMPLES 5 AND 6

This set of examples employed a 75/25 blend of "Vinol" 425/"Vinol" 205 polyvinyl alcohols supplied by Air Products. "Vinol" 425 is an intermediate hydrolyzed (94% by weight hydrolysis) and "Vinol 205 is a partially hydrolyzed (88% by weight hydrolysis) PVA grade. A sizing solution containing this blend of polyvinyl alcohols with 0.4% "Tergitol" 15-S-3 present (Ex. 3) was evaluated at 12 size add-on levels ranging from 5–15% (based on yarn weight) and compared with similar formulations prepared with the unmodified blend (Ex. C-5) and with the blend containing 8% "Synchem" 110 wax (Ex. C-6). The results are summarized in Table III.

TABLE III

| Example | Composition | Drum Deposit Obs'd (mg) | Drum Deposit Rating | $F_{50}$ Abrasion Resistance Obs'd (Cycles) | $F_{50}$ Abrasion Resistance Rating | Dye Receptivity Obs'd (Sec) | Dye Receptivity Rating |
|---|---|---|---|---|---|---|---|
| 3 | 75/25 "Vinol" 425/ "Vinol" 205 + 0.4% "Tergitol" 15-S-3 | 2.8 | 0.167 | 1585 | 0.935 | 3.8 | 5.7632 |
| C-5 | 75/25 "Vinol" 425/ "Vinol" 205 | 22.2 | 1.000 | 2415 | 0.988 | 4.0 | 5.475 |
| C-6 | 75/25 "Vinol" 425/ "Vinol" 205 + 8% "Synchem" 110 Wax | 0.5 | 0.030 | 975 | 0.879 | 20.8 | 1.0529 |

As can be seen from the above data, the additive of the present invention provided the same advantages with compositions based on intermediate and partially hydrolyzed polyvinyl alcohols as was observed with the vinyl alcohol polymer compositions described in Examples 1 and 2.

EXAMPLE 4 AND COMPARATIVE EXAMPLES 7 AND 8

A size formulation containing a 75/25 PVA No. 2/"Kofilm" 50 starch blend, 0.4% "Tergitol" 15-S-3 and 1.5% "Carbowax" 600, (Ex. 4) was evaluated at 12 add-on levels ranging from 5-15% (based on the yarn weight) and compared with a similar formulation containing no additives (Ex. C-7) as well as one with 8% "Synchem" 110 wax (Ex. C-8) present. The results are summarized in Table IV.

TABLE IV

| Example | Composition | Drum Deposit Obs'd (mg) | Drum Deposit Rating(1) | $F_{50}$ Abrasion Resistance Obs'd (Cycles) | $F_{50}$ Abrasion Resistance Rating(1) | Dye Receptivity Obs'd (Sec) | Dye Receptivity Rating |
|---|---|---|---|---|---|---|---|
| 4 | 75/25 PVA No. 2/ "Kofilm" 50 + 0.4% "Tergitol" 15-S-3 + | 2.8 | 0.163 | 665 | 0.953 | 2.9 | 7.576 |

TABLE IV-continued

| Example | Composition | Drum Deposit Obs'd (mg) | Drum Deposit Rating(1) | $F_{50}$ Abrasion Resistance Obs'd (Cycles) | $F_{50}$ Abrasion Resistance Rating(1) | Dye Receptivity Obs'd (Sec) | Dye Receptivity Rating |
|---|---|---|---|---|---|---|---|
| | 1.5% "Carbowax" 600 | | | | | | |
| C-7 | 75/25 PVA No. 2/ "Kofilm" 50 | 17.2 | 1.000 | 915 | 1.000 | 2.9 | 7.576 |
| C-8 | 75/25 PVA No. 2/ "Kofilm" 50 + 8% "Synchem" 110 Wax | 0.6 | 0.035 | 595 | 0.937 | 17.7 | 1.238 |

Footnotes
(1)Setting the performance observed for Comparative Example 7 at unity.

The above data showed that the additive of the present invention in PVA/starch based systems significantly reduces the drum deposit and increases the dye receptivity of the yarn. The adverse effect of the additive of the present invention on abrasion resistance was observed to be no greater than that of "Synchem" 110 wax.

EXAMPLE 5 AND COMPARATIVE EXAMPLES 9 AND 10

A size formulation derived from a 50/50 PVA No.2/"Kofilm" 50 starch blend and containing 0.4% "Tergitol" 15-S-3 and 1.5% "Carbowax" 600 (Ex. 5) was evaluated at 12 size add-on levels ranging from 5–15% (based on yarn weight) and compared with a similar size formulation containing no additives (Ex. C-9) as well as a formulation with 8% "Synchem" 110 wax (Ex. C-10) present. The results are summarized in Table V.

TABLE V

| Example | Composition | Drum Deposit Obs'd (mg) | Drum Deposit Rating(1) | $F_{50}$ Abrasion Resistance Obs'd (Cycles) | $F_{50}$ Abrasion Resistance Rating(1) | Dye Receptivity Obs'd (Sec) | Dye Receptivity Rating |
|---|---|---|---|---|---|---|---|
| 5 | 50/50 PVA No. 2/ "Kofilm" 50 + 0.4% "Tergitol" 15-S-3 + 1.5% "Carbowax" 600 | 4.2 | 0.167 | 275 | 0.875 | 3.7 | 5.917 |
| C-9 | 50/50 PVA No. 2/ "Kofilm" 50 | 25.2 | 1.000 | 615 | 1.000 | 4.3 | 5.102 |
| C-10 | 50/50 PVA No. 2/ "Kofilm" 50 + 8% "Synchem" 110 Wax | 0.9 | 0.036 | 335 | 0.905 | 9.3 | 2.353 |

Footnotes
(1)Setting the performance rating of Comparative Example 9 at unity.

As shown by the above data the additive of the present invention provided beneficial effects when used with 50/50 vinyl alcohol polymer/starch blends in both drum deposit performance as well as in dye receptivity. The additive reduced abrasion resistance to approximately the same extent as did the "Synchem" 110 wax additive.

COMPARATIVE EXAMPLES 11–13

Size formulations based on PVA No. 2 were prepared with several low ethylene oxide adducts of linear alcohols namely "Tergitol" 25-L-3, "Alfonic" 1012-40 and "Alfonic" 1412-40 (Ex. C-11 to 13).

Data characterizing the low ethylene oxide adducts is summerized in the Table below.

| Product | Hydrophobic Mol Wt. | Hydrophobic No Carbons | Ethylene Oxide Moles | Ethylene Oxide Wt. % |
|---|---|---|---|---|
| "Alfonic" 1012-40 | 170 | C 10.9 | 2.5 | 40 |
| "Alfonic" 1412-40 | 206 | C 13.4 | 3.0 | 40 |
| "Tergitol" 15-S-3 | 200 | C 13 | 3.0 | 37 |
| "Tergitol" 25-L-3 | 200 | C 13 | 3.0 | 37 |

The hydrophobe is a linear alcohol in the "Alfonic" products and in "Tergitol" 25-L-3 but is secondary alcohol in "Tergitol" 15-S-3. The above Table shows that "Alfonic" 1412-40 and "Tergitol" 25-L-3 are an almost exact linear counterparts of "Tergitol" 15-S-3. The "Alfonic" products are supplied by Conoco and the "Tergitol" products are supplied by Union Carbide.

Table VI shows the composition and properties of size formulations prepared with the above linear alcohol derived ethylene oxide adducts as well as with the additive of the present invention (Ex. 1).

TABLE VI

| Example | Composition | Drum Deposit Obs'd (mg) | Drum Deposit Rating | $F_{50}$ Abrasion Resistance Obs'd (Cycles) | $F_{50}$ Abrasion Resistance Rating | Dye Receptivity Obs'd (Sec) | Dye Receptivity Rating |
|---|---|---|---|---|---|---|---|
| C-11 | PVA No. 2 + 0.4% "Tergitol" 25-L-3 + 3.0% "CARBOWAX" 600 | 4.6 | 0.274 | 635 | 0.819 | 3.5 | 6.217 |
| C-12 | PVA No. 2 + 0.4% "Alfonic" 1012-40 + 3.0% "CARBOWAX" 600 | 4.9 | 0.292 | 485 | 0.784 | 3.6 | 6.086 |
| C-13 | PVA No. 2 + 0.4% "Alfonic" 1412-40 + 3.0% "CARBOWAX" 600 | 6.7 | 0.400 | 455 | 0.776 | 3.5 | 6.257 |
| 1 | PVA No. 2 + 0.4% "Tergitol" 15-S-3 + 3.0% "CARBOWAX" 600 | 1.1 | 0.066 | 1070 | 0.885 | 3.5 | 6.257 |

As can be seen from the above data, the formulations (Ex. C-11 to 13) containing a linear alcohol-based additive gave significantly inferior drum deposit and abrasion resistance performance than were observed when the additive of the present invention was used.

EXAMPLES 6-8 AND COMPARATIVE EXAMPLES 14-20

Size formulations were prepared with PVA No. 2 modified with a range of "Tergitol" 15-S products containing from 3 to 40 ethylene oxide units (i.e. "Tergitol" 15-S-3 to "Tergitol" 15-S-40). The level of the "Tergitol" additive was 0.4 wt. %, and 3.0% "Carbowax" 600 was also present in the formulation. Included in Table VII are characterization data for these formulations and a formulation containing only the "Carbowax" 600 additive.

TABLE VII

| Example | Composition: PVA Grade | Composition: "Tergitol" 15-S Grade (%) | Composition: "Carbowax" 600 (%) | Drum Deposit Obs'd (mg) | Drum Deposit Rating | $F_{50}$ Abrasion Resistance Obs'd (Cycles) | $F_{50}$ Abrasion Resistance Rating | Dye Receptivity Obs'd (Sec) | Dye Receptivity Rating |
|---|---|---|---|---|---|---|---|---|---|
| C-14 | PVA No. 2 | — | 3.0 | 9.0 | 0.536 | 1400 | 0.912 | 3.7 | 5.919 |
| 6 | PVA No. 2 | 15-S-3 (0.4) | 3.0 | 0.2 | 0.012 | 1070 | 0.885 | 3.5 | 6.257 |
| 7 | PVA No. 2 | 15-S-5 (0.4) | 3.0 | 1.5 | 0.089 | 850 | 0.856 | 3.6 | 6.083 |
| 8 | PVA No. 2 | 15-S-7 (0.4) | 3.0 | 1.3 | 0.077 | 670 | 0.825 | 3.8 | 5.763 |
| C-15 | PVA No. 2 | 15-S-9 (0.4) | 3.0 | 3.2 | 0.190 | 550 | 0.800 | 3.5 | 6.257 |
| C-16 | PVA No. 2 | 15-S-12 (0.4) | 3.0 | 4.3 | 0.256 | 415 | 0.765 | 3.6 | 6.083 |
| C-17 | PVA No. 2 | 15-S-15 (0.4) | 3.0 | 3.6 | 0.214 | 345 | 0.741 | 3.7 | 5.919 |
| C-18 | PVA No. 2 | 15-S-20 (0.4) | 3.0 | 3.6 | 0.214 | 330 | 0.735 | 3.5 | 6.257 |
| C-19 | PVA No. 2 | 15-S-30 (0.4) | 3.0 | 5.3 | 0.315 | 440 | 0.772 | 3.7 | 5.919 |
| C-20 | PVA No. 2 | 15-S-40 (0.4) | 3.0 | 4.7 | 0.292 | 315 | 0.730 | 3.6 | 6.083 |

As shown by the data in Table VII, the additives of the present invention ("Tergitol" 15-S-3, 15-S-5 and 15-S-7) gave improved results (Ex. 6-8). "Tergitols" 15-S-9 to 40 (Ex. C-15 to 20) gave significantly inferior drum deposit performances. Moreover, the abrasion resistance values observed became increasingly lower as the number of ethylene oxide units in the "Tergitol" additive was increased.

EXAMPLE 9 AND COMPARATIVE EXAMPLE 21

Fabric samples which have been prepared from yarn sized with the size solution of the present invention have been compared with fabric samples identical in every respect except that the latter were prepared with yarn sized with a commercial PVA/tallow wax formulation. Both sets of samples were desized under mild conditions (e.g. 15 seconds soak at 55° C. followed by three water rinses at 65° C). The dye receptivity of the fabrics obtained with the size of the present invention exhibited eight times the dye receptivity of those obtained using the conventional wax-containing size. Moreover dye absorption by the former was regular and uniform whereas that exhibited by the latter was highly irregular and nonuniform.

The fabric used in Examples 9 and C-21 consisted of a 65/35 polyester/cotton warp having a 36 singles cotton count, and filled with a 100% polyester weft so as to produce a 92/83 construction (ratio of warp threads to weft threads). The warp yarn was sized with a size formulation containing 12.5% solids and contained a size add-on of 15.0%. The size solution used in Example 9 consisted of PVA No. 2 containing 0.4% Tergitol 15-S-3 and 1.5% "Carbowax"600. The size solution used in Comparative Example 21 was the same as that used in Comparative Example 2 except that it contained 10% "Synchem" 110 wax instead of 8%.

We claim:

1. A composition consisting essentially of (a) from about 45.5 to about 99.9% by weight of vinyl alcohol polymer selected from the group consisting of polyvinyl alcohol, vinyl alcohol/methyl methacrylate copolymer, and polyvinyl alcohol containing solubilizing comonomers other than methyl methacrylate, said vinyl alcohol polymer having a saponification number of from about 1 to about 160 and a 4 percent solution viscosity of from about 3 to about 70 mPa.s at 20° C.:

(b) from about 0.1 to about 3 percent by weight of liquid nonionic low ethylene oxide adduct of branched alcohol or mixture of branched alcohols wherein the average ethylene oxide content is from about 1 to about 7 units and the alcohol has an average carbon content of from about 8 to about 18 carbon atoms;

(c) from 0 to 49.9 percent by weight of starch;

(d) from 0 to about 5 percent by weight of ethylene oxide oligomer having a molecular weight (number average) of from about 200 to about 800 and (e) from 0 to about 49.9 percent by weight of carboxymethyl cellulose, (f) from 0 to about 1 percent by weight of at least one auxiliary ethylene oxide adduct selected from the group consisting of low ethylene oxide adduct (containing an average ethylene oxide content of from about 1 to about 7 units) of a linear alcohol or of a mixture of linear alcohols (having an average carbon content of from about 8 to about 18 units) and medium to high ethylene oxide adduct (containing an average ethylene oxide content of from about 3 to about 40 units) of linear or branched alcohols (having an average carbon content of from about 8 to about 18 units) provided that the combined weight of starch and carboxymethyl cellulose does not exceed the weight of vinyl alcohol polymer.

2. The composition of claim 1 wherein the vinyl alcohol polymer is selected from the group consisting of fully hydrolyzed polyvinyl alcohol having a viscosity of from about 3 to about 70 mPa.s, fully hydrolyzed vinyl alcohol/methyl methacrylate copolymer which contains from about 3.5 to about 6 weight % of copolymerized methyl methacrylate comonomer having a viscosity of from about 3 to about 60 mPa.s, partially hydrolyzed polyvinyl alcohol containing from about 4 to about 12 mole % of vinyl acetate having a viscosity of from about 3 to about 60 mPa.s, polyvinyl alcohol containing solubilizing comonomers selected from the group consisting of methylacrylate and methyl hydrogen maleate having a viscosity of from about 3 to about 70 mPa.s and mixtures of said vinvl alcohol polymers.

3. The composition of claim 1 wherein the amount of vinyl alcohol polymer is from about 63 to about 99.8 % by weight, the amount of ethylene oxide adduct is from about 0.2 to about 1% by weight, the amount of starch is from 0 to about 33% by weight, the amount of ethylene oxide oligomer is from 0 to about 3% by weight, the amount of carboxymethyl cellulose is from 0 to about 33% by weight and wherein said ethylene oxide adduct has an average ethylene oxide content of from about 2 to about 5 and the alcohol has an average carbon content of from about 10 to about 15 carbon atoms.

4. The composition of claim 1 wherein the amount of vinyl alcohol polymer is from about 72.7 to about 99.6 % by weight, the amount of ethylene oxide adduct is from about 0.4 to about 0.8% by weight, the amount of starch is from 0 to about 25% by weight, the amount of ethylene oxide oligomer is from 0 to about 1.5% by weight, the amount of carboxymethyl cellulose is from 0 to about 25% by weight and wherein said ethylene oxide adduct has an average ethylene oxide content of about 3 and the alcohol has an average carbon content of about 13 carbon atoms.

5. A composition consisting essentially of (a) from about 45 to about 90% by weight of vinyl alcohol polymer selected from the group consisting of polyvinyl alcohol and vinyl alcohol/methyl methacrylate copolymer, and polyvinyl alcohol containing solubilizing comonomers other than methyl methacrylate, said vinyl alcohol polymer having a saponification number of from about 1 to about 160 and a 4 percent solution viscosity of from about 3 to about 70 mPa.s at 20° C.:

(b) from about 10 to about 55% by weight of liquid nonionic low ethylene oxide adduct of branched alcohol or mixture of branched alcohols wherein the average ethylene oxide content is from about 2 to about 7 units and the alcohol has an average carbon content of from about 8 to about 18 carbon atoms;

(c) from about 0 to 45 percent by weight of starch;

(d) from 0 to about 45 percent by weight of ethylene oxide oligomer having a molecular weight (number average) of from about 200 to about 800 and (e) from 0 to about 45 percent by weight of carboxymethyl cellulose, (f) from 0 to about 45 percent by weight of an auxiliary ethylene oxide adduct selected from the group consisting of low ethylene oxide adduct (containing an average ethylene oxide content of from about 1 to about 7 units) of a linear alcohol or of a mixture of linear alcohols (having an average carbon content of from about 8 to about 18 units) and medium to high ethylene oxide adduct (containing an average ethylene oxide content of from about 8 to about 40 units) of linear or branched alcohols (having an average carbon content of from about 8 to about 18 units).

6. The composition of claim 5 wherein the vinyl alcohol polymer is selected from the group consisting of fully hydrolyzed polyvinyl alcohol having a viscosity of from about 3 to about 70 mPa.s, fully hydrolyzed vinyl alcohol/methyl methacrylate copolymer, which contains from about 3.5 to about 6 weight % of copolymerized methyl methacrylate comonomer having a viscosity of from about 3 to about 60 mPa s, partially hydrolyzed polyvinyl alcohol containing from about 4 to about 12 mole % of vinyl acetate having a viscosity of from about 3 to about 60 mPa s, polyvinyl alcohol containing solubilizing comonomers selected from the group consisting of methylacrylate and methyl hydrogen maleate having a viscosity of from about 3 to about 70 mPa.s and mixtures of said vinyl alcohol polymers and mixtures of said vinyl alcohol polymers.

7. The composition of claim 5 wherein the amount of vinyl alcohol polymer is from about 45 to about 70% by weight, the amount of ethylene oxide adduct is from about 30 to about 55% by weight, the amount of starch is from 0 to about 25% by weight, the amount of ethylene oxide oligomer is from 0 to about 25% by weight, the amount of carboxymethyl cellulose is from 0 to about 25% by weight and wherein said ethylene oxide adduct has an average ethylene oxide content of from about 3 to about 5 and the alcohol has an average carbon content of from about 10 to about 19 carbon atoms.

8. The composition of claim 5 wherein the amount of vinyl alcohol polymer is from about 50 to about 60% by weight, the amount of ethylene oxide adduct is from about 40 to about 50% by weight, the amount of starch is from 0 to about 5% by weight, the amount of ethylene oxide oligomer is from 0 to about 5% by weight, the amount of carboxymethyl cellulose is from 0 to about 5% by weight and wherein said ethylene oxide adduct has an average ethylene oxide content of about 3 and the alcohol has an average carbon content of about 13 carbon atoms.

9. A wax-free aqueous size solution comprising the composition of claims 1, 2, 3 or 4 having a solids content of from about 2 to about 20% by weight.

10. A wax-free aqueous size solution comprising the composition of claims 1, 2, 3 or 4 having a solids content of from about 5 to about 15% by weight.

11. A wax-free aqueous size solution comprising the composition of claims 1, 2, 3 or 4 having a solids content of from about 7 to about 12% by weight.

12. A process for sizing spun yarn with wax-free aqueous solution comprising the composition of claims 1, 2, 3 or 4 having a solids content of from about 2 to about 20% by weight.

13. A process for sizing spun yarn with wax-free aqueous solution comprising the composition of claims 1, 2, 3 or 4 having a solids content of from about 5 to about 15% by weight.

14. A process for sizing spun yarn with wax-free aqueous solution comprising the composition of claims 1, 2, 3 or 4 having a solids content of from about 7 to about 12% by weight.

15. Sized yarn comprising spun yarn having a wax-free protective surface coating of the composition of claims 1, 2, 3 or 4.

16. Sized yarn comprising spun yarn having a wax-free protective surface coating of the composition of claims 1, 2, 3 or 4, wherein said yarn is selected from the group consisting of cotton and polyester/cotton spun yarns.

17. Sized yarn comprising spun yarn having a wax-free protective surface coating of the composition of claims 1, 2, 3 or 4, wherein said yarn is selected from the group consisting of 65/35, 50/50 and 40/60 polyester/-cotton spun yarn.

18. Fabric prepared from sized yarn comprising spun yarn having a wax-free protective surface coating of the composition of claims 1, 2, 3 or 4, wherein said yarn is selected from the group consisting of 65/35, 50/50 and 40/60 polyester/cotton spun yarn.

19. Fabric prepared from sized yarn comprising spun yarn having a wax-free protective surface coating of the composition of claims 1, 2, 3 or 4.

20. Fabric prepared from sized yarn comprising spun yarn having a wax-free protective surface coating of the composition of claims 1, 2, 3 or 4, wherein said yarn is selected from the group consisting of cotton and polyester/cotton spun yarns.

* * * * *